US005113562A

United States Patent [19]

Studt

[11] Patent Number: 5,113,562

[45] Date of Patent: May 19, 1992

[54] METHOD FOR REVERSING MOUNTING SIDE OF CLOTHES DRYER DOOR ASSEMBLY

[75] Inventor: Timothy K. Studt, Ripon, Wis.

[73] Assignee: Speed Queen Company, Lexington, Mass.

[21] Appl. No.: 677,216

[22] Filed: Mar. 29, 1991

[51] Int. Cl.[5] ..... B21K 21/16; B23P 17/04; B23P 23/00

[52] U.S. Cl. ..... 29/401.1; 34/201

[58] Field of Search ..... 29/401.1; D25/48; 34/91, 201, 243 R; 312/243

[56] References Cited

U.S. PATENT DOCUMENTS 4,238,876 12/1980 Monroe et al. ..... 29/401.1

4,251,104 2/1981 Holt ..... 29/401.1 X

*Primary Examiner*—Timothy V. Eley

*Attorney, Agent, or Firm*—William R. Clark; Richard M. Sharkansky

[57] ABSTRACT

A clothes dryer door assembly adapted for mounting in alternate positions so that the door assembly can be made to open from either side. The door assembly includes an outer panel to which a handle, latching mechanism, and hinges are mounted, and inner liner having a bowed out lower portion forming an internal chamber through which air is exhausted to a lint filter. In reversing the mounting side, the inner liner is first disconnected from the door panel and then reconnected after the door panel has been inverted. Thus, the hinges, handle, and latching mechanism of the door panel are relocated for mounting to the opposite side of the access opening of the dryer cabinet, but the lower portion of the liner remains on the bottom.

6 Claims, 3 Drawing Sheets

METHOD FOR REVERSING MOUNTING SIDE OF CLOTHES DRYER DOOR ASSEMBLY

BACKGROUND OF THE INVENTION

The invention generally relates to clothes dryers, and more particularly relates to door assemblies for clothes dryers and a method for reversing the side from which a door assembly opens.

As is well known, a domestic clothes dryer typically has a cabinet including a front panel with an access opening through which clothes are loaded and unloaded. Generally, a door mounts with hinges to the cabinet front panel on one side of the access opening.

There are many laundry areas where the loading of clothes into a dryer is inhibited because the door is hinged on one particular side. For example, in many installations, the location of the washing machine relative to the dryer is fixed by pre-existing plumbing and/or dryer vent holes. However, if the dryer door is hinged on the side of the washer, it is inconvenient to move the clothes from the washer to the dryer because the clothes have to be passed over or in front of the open dryer door. Also, in an upstairs installation such as in a closet or alcove, a folding door or other permanent fixture may prevent or encumber the opening of a dryer door from one side or the other. Thus, it would be desirable to have a dryer door that could be reversed so that it could readily be hung or mounted from either side of the access opening depending on the requirements of the particular installation. Further, it may be desirable for a manufacturer to be able to easily reverse the mounting side to provide product differentiation between models.

Many commercially available refrigerators have doors that can be hung from either side. In the typical reversing process, the hinges are relocated from one side to the other, and the door handles and trim are mounted to the side edge of the door using screws so that they can also be readily relocated. Such method, however, is not generally applicable to clothes dryers. First, many dryers have a recessed door handle that can't be disconnected from one side and then relocated to the other side. Also, if the door handle is mounted with screws to the face of the door, relocating it from one side to the other would leave screw holes that would have an undesirable appearance even if filled with plugs. Further, a dryer door typically fits into a recess in the cabinet front panel, so there generally is no space available at the side of the door for mounting a handle.

Another possible method of reversing the door mounting would be to remove the hinges from the cabinet front panel, invert the door so that the right is on the left and the left is on the right, and then reattach the hinges on the opposite side of the dryer cabinet. This method would have a drawback, however, because most dryer doors are not symmetrical. More specifically, in the typical arrangement, the door is an assembly including an outer panel and an inner liner which are spaced at the bottom to provide a lower internal chamber through which air is exhausted from the clothes drum. That is, the lower portion of the inner liner has perforations that face the clothes drum and an aperture formed on the underside of the chamber. Thus, the perforations, chamber, and bottom aperture provide a passageway for air to be drawn from the clothes drum through the door and into a lint filter that is disposed in the access opening below the door. The advantage of having a non-symmetric door with a relatively thin top portion is that there is more clothes volume with the dryer. If such a door were inverted to reverse the hinges and handle, the chamber would be at the top. Further, even if the door had the same thickness all the way up (i.e. geometrically symmetrical), inverting the door would position the perforations and the aperture at the top.

SUMMARY OF THE INVENTION

In accordance with the invention, a method is provided for reversing the opening side of a clothes dryer door assembly mounted by hinges to a dryer cabinet front panel on one side of the clothes access opening wherein the door assembly includes a door panel and an inner liner. The method comprises the steps of disconnecting the hinges from the cabinet front panel to remove the door assembly from the cabinet, disengaging the inner liner from the door panel, inverting the door panel with respect to the inner liner, reengaging the inner liner to the door panel, and then connecting the hinges to the cabinet front panel on the opposite side of the access opening to mount the door assembly to the cabinet.

The inventive method can also be practiced with a clothes dryer having a clothes drum disposed within a cabinet having a front panel with an access opening to the clothes drum and a door assembly mounted by hinges to the front panel on one side of the access opening wherein the door assembly comprises an inner liner secured to a door panel by screws that attach the hinges to the door assembly. The inner liner has a lower portion spaced from the door panel wherein the inner liner has a bottom aperture and holes or perforations that communicate with the clothes drum to provide a passageway for exhaust air to flow from the clothes drum through the perforations and the internal chamber of the door assembly and out the bottom aperture into a lint filter disposed below the door. In accordance with the invention, a method of reversing the mounting side of the door assembly comprises the steps of disconnecting the hinges from the cabinet front panel to remove the door assembly from the cabinet, removing the screws to disconnect the hinges from the door assembly, disengaging the inner liner from the door panel, inverting the door panel with respect to the inner liner, reengaging the inner liner to the door so that the orientation of the door panel to the inner liner is inverted from the initial orientation of the door assembly, attaching the hinges with the screws to the opposite side of the door assembly, and connecting the hinges to the front panel on the opposite side of the access opening to mount the door assembly to the cabinet.

With such arrangement, the outer panel of the door assembly is inverted so that the handle and the hinge side are relocated to their respective opposite or reversed sides. Therefore, a recessed handle or a handle that connects to the face of the door can be used. Furthermore, by removing the inner liner before inverting the door panel, the inner liner remains in its original orientation so that it can be made non-symmetrical. That is, a passageway chamber can be located at the bottom of the door assembly, and it remains on the bottom even though the mounting is reversed. Further, the holes in the liner are still located at the bottom as is the aperture through which the exhaust air passes to the lint filter. Another advantage is that the reversing method can be accomplished without kits including additional parts or special tools. The method can be accomplished using just a screw driver to remove the screws. The screws mounting the hinges to the door panel can also be used along with other screws to attach the door panel to the inner liner, but in such case, the additional steps of removing and then reattaching the hinges are performed.

BRIEF DESCRIPTION OF THE DRAWINGS

The foregoing objects and advantages will be more fully understood by reading the description of the preferred embodiment with reference to the drawings wherein.

DESCRIPTION OF THE PREFERRED EMBODIMENTS

Figure 1:
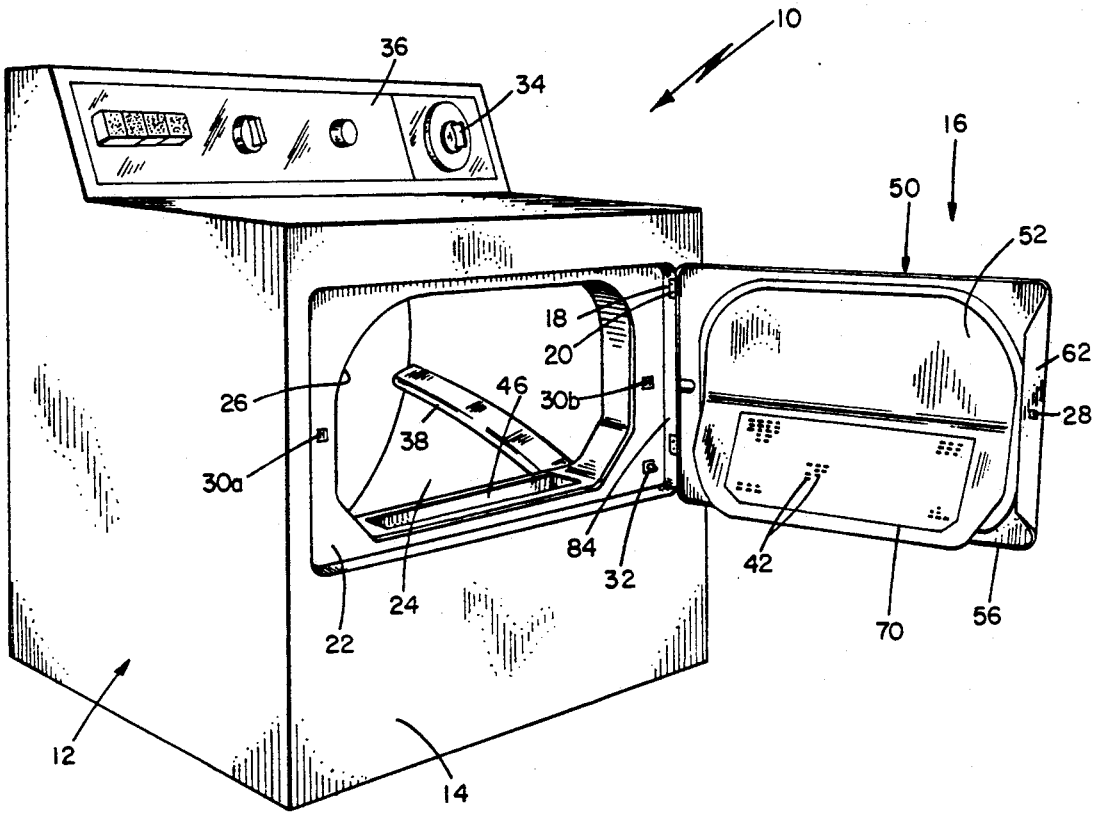
FIG. 1 is a perspective view of a domestic clothes dryer.

Referring to the drawings wherein like numerals refer to like parts throughout the several views, FIG. 1 shows a domestic clothes dryer 10 including a cabinet 12 having a front panel 14. A door assembly 16 is connected to front panel 14 by hinges 18 and screws 20, and door assembly 16 fits into a recess 22 in front panel 14 when closed. In conventional manner, clothes to be dried are loaded into clothes drum 24 through access opening 26 and door assembly 16 is then closed. Latching is provided by striker 28 or other suitable apparatus engaging with door catch 30*a*, as shown. Door assembly 16 depresses door switch 32 thereby enabling the actuation of dryer 10.

In conventional manner, the control knob 34 on control panel 36 is then set to a desired operating program or drying period, and then hot air is introduced into clothes drum 24 by suitable conventional apparatus which is not shown here as it is not required for an understanding of the invention. Also, clothes drum 24 is rotated by suitable conventional apparatus so that vanes 38 lift and mix the clothes to enhance drying.

Figure 3:
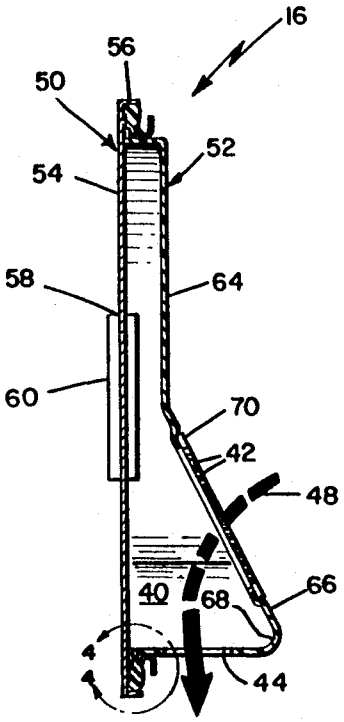
FIG. 3 is a view taken along line 3—3 of FIG. 2.

Still referring to FIG. 1 and also to FIG. 3, door assembly 16 has an internal chamber 40 in a bottom portion thereof, and chamber 40 has a plurality of perforations 42 or small holes that face clothes drum 24. Also, chamber 40 has a bottom aperture 44 which is adjacently spaced from lint filter 46 when door assembly 16 is in the closed position. Thus, a passageway 48 is provided from clothes drum 24 through chamber 40 into lint filter 46. Using conventional apparatus, exhaust air is drawn through this passageway 48 into lint filter 46 before being vented outside or partially being recirculated back into clothes drum 24. That is, a negative pressure is provided below lint filter 46, and the exhaust air from clothes drum 24 is drawn through perforations 42, chamber 40, and down through aperture 44. As is well known, lint is collected in the lint filter 46 which is disposed at a convenient location in access opening 26 where it can easily be cleaned between each drying cycle.

As shown in FIG. 1, door assembly 16 is here initially mounted on the right side of access opening 26 so that door assembly 16 is opened from the left. In accordance with the invention, apparatus and method are provided for easily and readily reversing the mounting side of door assembly 16 so that it can be opened from the right depending on the requirements of the dryer installation. The first step of the reversing process is to disconnect the hinges 18 from the front panel 14 of the cabinet 12 by removing screws 20. In such manner, the door assembly 16 is removed from the cabinet.

Figure 2:
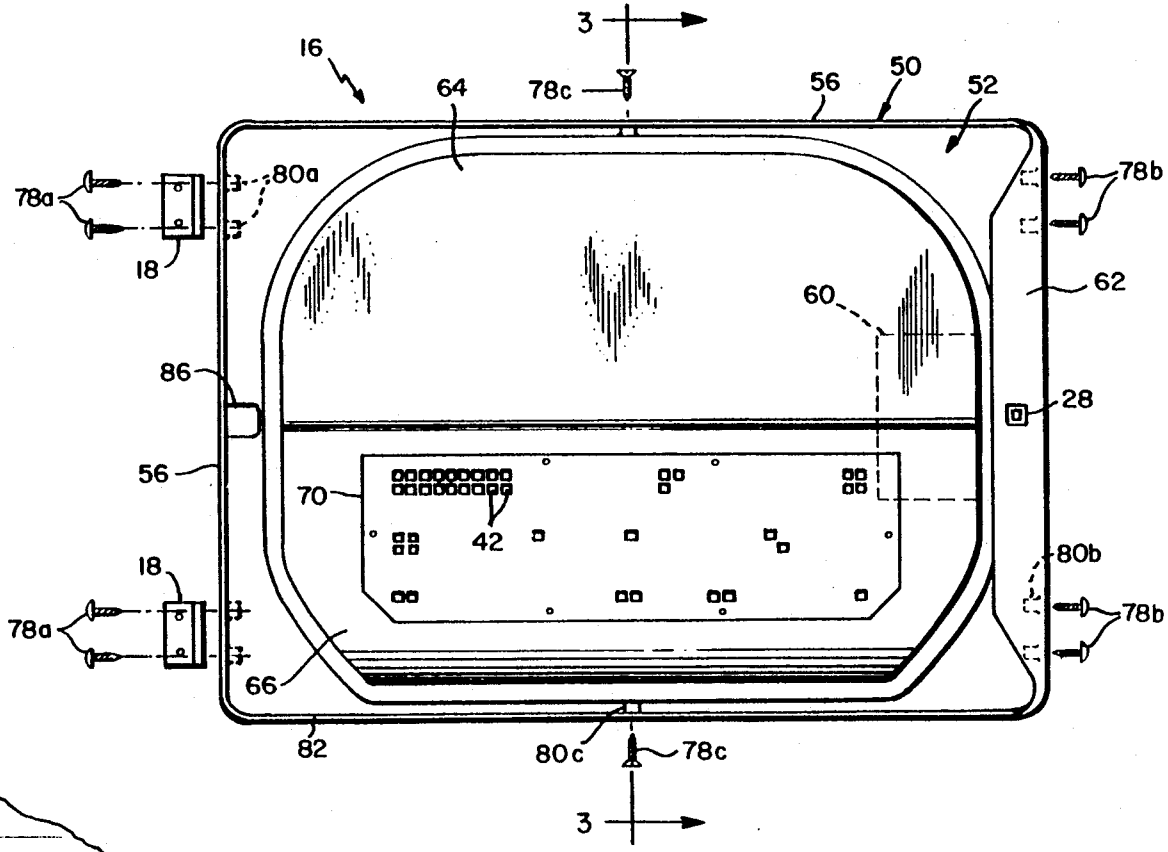
FIG. 2 is an expanded back view of the door assembly of FIG. 1.

Referring to FIGS. 2 and 3, door assembly 16 includes an outer door panel 50 and an inner liner 52. Door panel 50 is here fabricated from sheet metal, and has a face panel 54 with an orthogonal lip 56. Here, face panel 54 has a slot 58 in which a conventional recessed handle 60 is disposed, but alternately a protruding handle could be fixedly mounted to face panel 54 in conventional manner. Door panel 50 also has a striker mounting plate 62 which is a metal band connected to the lip 56 on the opening side, such plate 62 being disposed parallel with face panel 54. A conventional striker 28 is mounted to striker mounting plate 62.

The inner liner 52 is here a plastic molded part that has an upper portion 64 that is closely spaced to face panel 54 as shown best in FIG. 3, and a lower portion 66 that bows away from face panel 54 to form chamber 40. That is, inner liner 52 has a hollow 68 with perforations 42 at the side and aperture 44 at the bottom such that when inner liner 52 is connected to door panel 50, inner chamber 40 is formed thereby providing passageway 48 through the perforations 42 and aperture 44. Although alternate arrangements could be used, perforations 42 are here provided by connecting a metal grid 70 or plate to inner liner 52.

Figure 4:
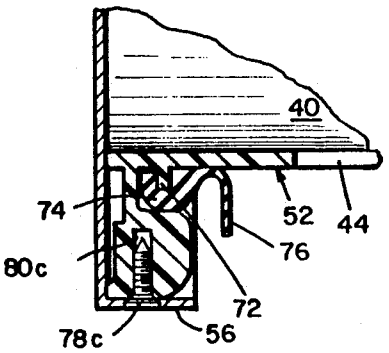
FIG. 4 is an expanded view of line 4—4 in FIG. 3.

Referring to FIG. 4, inner liner 52 has a peripheral rib 72 or ring to which a gasket 74 is connected in conventional manner. Gasket 74 has a flexible flap 76 which seals against the face of recess 22 when door assembly 16 is closed.

Still referring to FIG. 4 and also to FIG. 2, inner liner 52 is connected to door panel 50 by a plurality of screws 78*a–c* that are driven in through orthogonal lip 56 of door panel 50 and into corresponding screw bores 80*a–c* in the respective perimeter edges 82 of liner 52. More specifically, screws 78*a* pass through hinges 18 and lip 56 thereby connecting hinges 18 to door assembly 16, and also connecting one side of inner liner 52 to door panel 50. On the side of door assembly 16 opposite hinges 18, screws 78*b* are mounted at corresponding vertical positions to screws 78*a*. Further, as shown in FIG. 2, screws 78*c* connect inner liner 52 to door panel 50 on the top and bottom.

Figure 5A:
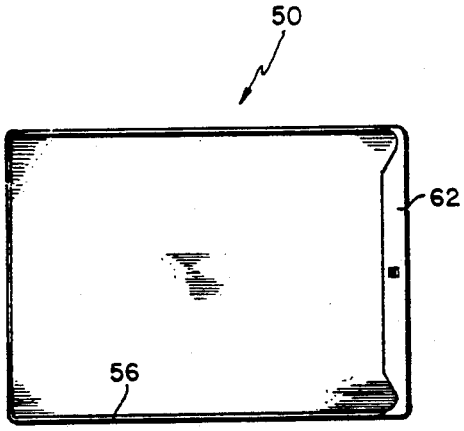
FIGS. 5A and 5B show a step in reversing the mounting side of the door assembly.
Figure 5B:
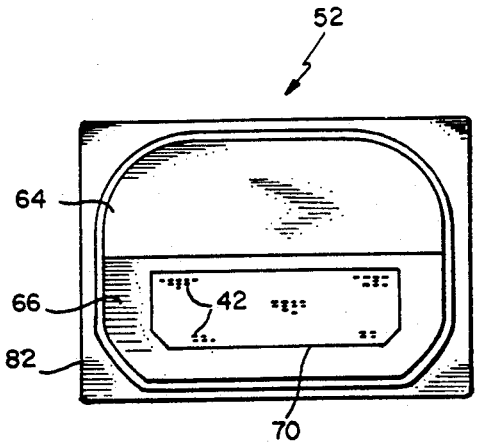

In the next step of reversing the mounting side of door assembly 16 after removing door assembly 16 from cabinet 12, screws 78*a–c* are removed as shown in FIG. 2. Accordingly, inner liner 52 is free to be removed from door panel 50. More specifically, the side of door liner 52 opposite striker mounting plate 62 is pulled away from door panel 50, and then inner liner 52 is slid outwardly so that it is separated from door panel 50, as shown in FIGS. 5A and 5B.

Figure 6A:
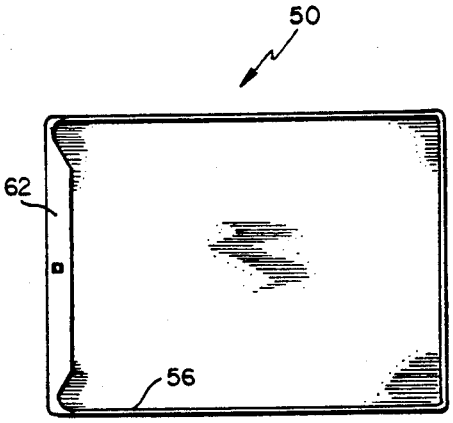
FIGS. 6A and 6B show a subsequent step in reversing the mounting side of the door assembly.
Figure 6B:
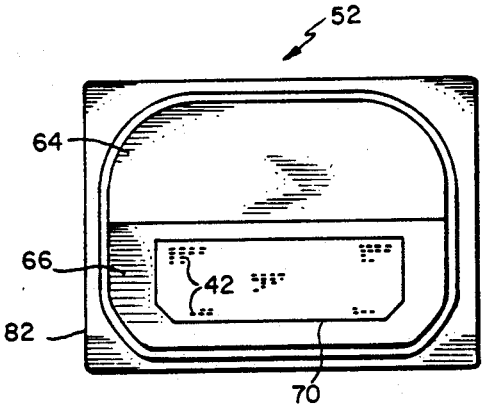

The next step in reversing the door mounting for door assembly 16 is to invert the door panel 50 as shown in FIG. 6A with respect to the inner liner 52 as shown in FIG. 6B. That is, while inner liner 52 remains in the initial orientation, door panel 50 is inverted so that the left side relocates to the right and the right side relocates to the left. By such action, the striker mounting plate 62 and the corresponding handle 60 on the face side are relocated to the opposite or left side as shown in FIG. 6A.

Figure 7:
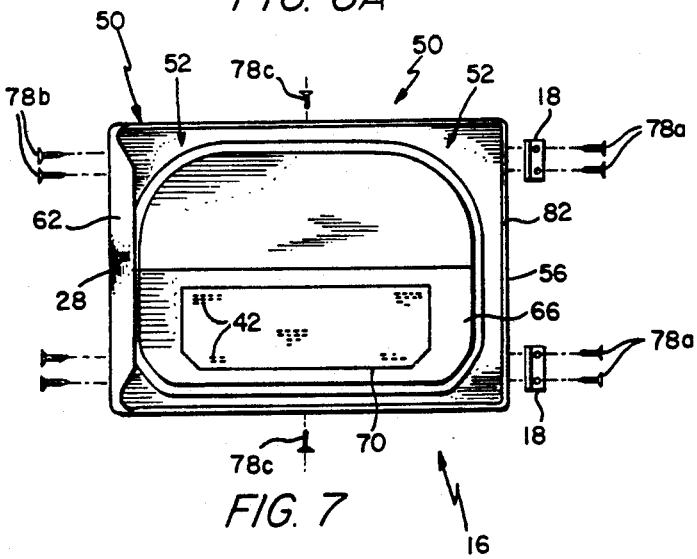
FIG. 7 shows another subsequent step in reversing the mounting side of the door assembly.

Next, as shown in FIG. 7, the inner liner 52 is slid underneath striker mounting plate 62 of door panel 50 and then inner liner 52 is lowered against door panel 50 such that its perimeter edges 82 are adjacent lip 56. The screw bores 80*a–c* are symmetrically arranged so that they align with corresponding screw holes in lip 56 when door panel 50 is in either of its described alternately inverted orientations. Thus, screws 78*a–c* are replaced in their original positions even though door panel 50 has been inverted from its original orientation. That is, screws 78*a* are used to attach hinges 18 to the side of door panel 50 opposite striker mounting plate 62. Also, screws 78*b* connect door panel 50 to inner liner 52 on the side of striker mounting plate 62. Further, screws 78*c* connect door panel 50 to inner liner 52 at the top and bottom. As a result of such steps, the door panel 50 of FIG. 7 is in the inverted orientation from that shown in FIG. 2, but the inner liner 52 is in the same orientation. Thus, the striker mounting plate 62, striker 28, hinges 18 and handle 60 are all relocated to the respective opposite sides (i.e. right to left and visa versa), but the lower portion 66 of inner liner 52 remains at the bottom so that the passageway 48 remains identical to its initial orientation.

Although not shown in the drawings, the final step is to remount the hinges 18 to the opposite side—here shown as the left in FIG. 1—of the access opening 26. The shoulder 84 of recess 22 is provided with corresponding hinge mounting screw holes on both the left and right side, and the unused holes are preferably filled with plugs (not shown). Thus, before mounting the newly oriented door assembly 16 to the left side, the plugs are moved from the left to the right thereby uncovering screw holes to mount the door assembly 16 on the left. An alternate door catch 30*b* is provided on the right side of recess 22 to latch the striker 28 when the door assembly is mounted to the left side of access opening 26. Inner liner 52 has an indentation 86 aligned with the unused door catch 30*a* or *b* so that inner liner 52 can fit flush with recess 22. The only additional parts required to effectuate the door mounting reversal as described heretofore are the additional set of screw holes and corresponding plugs on the shoulder 84 of recess 22, and a second door catch 30*b* to be operative from the opposite side. All of the other parts are used in both alternate mounting orientations. Door switch 32 is actuated when door assembly 16 is mounted on either side.

In an alternate embodiment, inner liner 52 is attached to door panel 50 without using screws 78*a*. For example, hinges 18 are mounted to the lip 56 of door panel 50 opposite striker mounting plate 62 using screws or other suitable fasteners such as rivets that do not engage inner liner 52. Accordingly, there is no need to remove hinges 18 from door panel 50 before inverting the door panel 50 as shown in FIG. 6A. Therefore, hinges 18 are relocated to the opposite side merely by inverting door panel 50, and hinges 18 are never removed from door panel 50. Stated differently, by using screws 78*a* to both mount hinges 18 to lip 56 and also to attach one side of inner liner 52 to door panel 50, the additional steps of removing and then reattaching hinges 18 are required.

In accordance with the invention, a door assembly 16 and method are provided for easily and readily changing the mounting side of a clothes dryer door. The door assembly 16 is removed from the dryer cabinet, and then the door panel 50 is inverted (i.e. relocating left to right and right to left) while leaving the inner liner 52 in its initial orientation. Therefore, the hinges 18, striker 28, and door handle 60 are relocated to the respective opposite sides, while the door liner 52 remains in its initial orientation. Therefore, a non-symmetrical inner door liner 52 can be used that provides a lower passageway 48 for exhaust air, while still having a thin upper door portion to provide maximum volume within the dryer 10. Furthermore, the perforations 42 into the door chamber and the bottom exit aperture 44 remain in the same bottom location.

This concludes the description of the preferred embodiment. A reading of it by those skilled in the art will bring to mind many modifications and alterations that do not depart from the spirit and scope of the invention. Accordingly, it is intended that the scope of the invention be limited only by the appended claims.

What is claimed is:

1. A method comprising the steps of:

disconnecting a door assembly comprising a door panel and an inner liner from one side of a clothes dryer;

inverting the door panel of the door assembly with respect to the inner liner to reverse the respective sides of a handle and hinges of the door assembly while leaving the inner liner in its original orientation; and reconnecting the door assembly to the clothes dryer so that the door assembly opens from the opposite side.

2. The method recited in claim 1 further comprising the steps of removing hinge screws that connect the door panel to the inner liner before inverting the door panel, and then reconnecting the hinges to the opposite side of the door assembly after the door panel has been inverted.

3. A method of reversing the opening side of a clothes dryer door assembly mounted by hinges to a dryer cabinet front panel on one side of the clothes access opening wherein the door assembly includes a door panel and an inner liner, comprising the steps of:

disconnecting said hinges from said cabinet front panel to remove said door assembly from said cabinet;

disengaging said inner liner from said door panel;

inverting said door panel with respect to said inner liner;

reengaging said inner liner to said door panel; and connecting said hinges to said front panel on the opposite side of said clothes access opening to mount said door assembly to said cabinet.

4. The method recited in claim 1 wherein said door panel has a lip adapted for surrounding said inner liner, and said inner liner is disengaged from said door panel by first removing a plurality of screws secured through said lip into said inner liner.

5. The method recited in claim 4 wherein predetermined ones of said plurality of screws secure said hinges to said door assembly, and said method further comprises the steps of disconnecting said hinges from said door assembly by removing said predetermined ones of said plurality of screws before inverting said door panel, and then reconnecting said hinges on the opposite side of said door panel after said door panel is inverted by reinserting said predetermined ones of said plurality of screws.

6. In a clothes dryer having a clothes drum disposed within a cabinet having a front panel with an access opening to the clothes drum and a door assembly mounted by hinges to the front panel on one side of the access opening wherein the door assembly comprises an inner liner secured to a door panel by screws that attach the hinges to the door assembly, the door liner having a lower portion spaced from the door panel and having a bottom aperture and holes communicating with the clothes drum to provide a passageway for exhaust air to flow from the clothes drum through the perforations through an internal chamber of the door assembly and out the bottom aperture into a lint filter disposed below the door, a method of reversing the mounting side of the door assembly comprising the steps of:

disconnecting the hinges from the cabinet front panel to remove the door assembly from the cabinet;

removing the screws to disconnect the hinges from the door assembly;

disengaging the inner liner from the door panel;

inverting the door panel with respect to the inner liner;

reengaging the inner liner to the door panel;

attaching the hinges with the screws to the opposite side of the door assembly; and connecting the hinges to the front panel on the opposite side of the access opening.

* * * * *